US006871912B1

(12) United States Patent
Chen

(10) Patent No.: US 6,871,912 B1
(45) Date of Patent: Mar. 29, 2005

(54) HIGHCHAIR

(75) Inventor: Shun-Min Chen, Taipei Hsien (TW)

(73) Assignee: Kenny Cheng, Taipei (TW)

( * ) Notice: Subject to any disclaimer, the term of this patent is extended or adjusted under 35 U.S.C. 154(b) by 0 days.

(21) Appl. No.: 10/691,983

(22) Filed: Oct. 23, 2003

(51) Int. Cl.[7] ..... A47C 1/02
(52) U.S. Cl. ..... 297/344.19; 297/378.1
(58) Field of Search ..... 297/344.19, 344.18, 297/378.1, 46, 16.1

(56) References Cited

U.S. PATENT DOCUMENTS

| | | | | |
|---|---|---|---|---|
| 3,166,282 A | | 1/1965 | Nolan | |
| 3,902,755 A | | 9/1975 | Sirot | |
| 5,447,358 A | | 9/1995 | Corlett | |
| 5,468,051 A | * | 11/1995 | Huang | 297/344.18 |
| 5,509,719 A | * | 4/1996 | Cone, II | 297/344.14 |
| 5,558,400 A | * | 9/1996 | Poulson et al. | 297/344.18 |
| 6,123,387 A | * | 9/2000 | Kelly | 297/188.18 |
| 6,345,864 B1 | * | 2/2002 | Rivera et al. | 297/130 |

FOREIGN PATENT DOCUMENTS

| | | | |
|---|---|---|---|
| DE | 195 01 461 A1 | | 3/1996 |
| DE | 296 10 591 U1 | | 10/1996 |
| DE | 203 07 192 U1 | | 10/2003 |
| JP | 6-38851 | * | 6/1994 |
| TW | 87219634 | | 11/1987 |
| TW | 89201109 | | 1/1989 |

* cited by examiner

*Primary Examiner*—Milton Nelson, Jr.
(74) *Attorney, Agent, or Firm*—Scully, Scott, Murphy & Presser

(57) ABSTRACT

A highchair comprising a base portion, a pneumatic cylinder and a seat portion. The base portion is connected to the pneumatic cylinder by a retaining clip and a fixing block. The pneumatic cylinder is connected to the seat portion and can pivotally rotate to a folded and parallel position with respect to the seat portion thereby to fold the highchair to a minimum volume.

3 Claims, 8 Drawing Sheets

HIGHCHAIR

FIELD OF INVENTION

The present invention relates to a multi-function highchair. More specifically, the present invention relates to an infant highchair configured to adjust the height thereof easily and can be folded into a minimum volume.

BACKGROUND OF THE INVENTION

Since the bones of an infant are suppler, the infant should be held by an adult or supported on a highchair to keep safely. However, long-term holding will produce the fatigue of the adult. Although the highchair can support the weight of the infant, the height of the highchair needs to be adjusted frequently to correspond to the growing up of the infant. Further, when dining out, it is very troublesome to bring the highchair out otherwise it is necessary to request a height-fixed highchair from the restaurant. Therefore, there is an increasing desire for an infant highchair capable of adjusting the height thereof easily and bringing out conveniently.

FIG. 1 shows a conventional infant highchair. In general, the leg frame is configured to form an inverted-V shape or L shape. The height-adjusting means is a locking slot. During the height adjustment, a user needs to press buttons (not shown) on both sides of the height-adjusting means 120 so as to move a sleeve 100 up and down along the leg tubes 110 whereby achieving the height adjustment of the infant highchair. However, the height adjustment would be more laborious due to the total weight of the infant pulse the highchair itself. Further, conventional highchairs also have a drawback that they cannot be detached and folded into a minimum volume due to the restriction of the leg frame so that it is very inconvenient in storage and conveyance.

SUMMARY OF THE INVENTION

In view of the above drawbacks of conventional infant highchairs, the present invention is achieved by the diligence and experience of the applicant. The object of this invention is to provide an improved highchair using a pneumatic cylinder as lifting means. The height adjustment of this invention can be easily performed with less labor by providing an activating device in the handgrip portion and also can be detached and folded into a minimum volume. Further, this invention is very convenient in conveyance and storage because it occupies the least space.

The highchair of this invention comprises a base portion, a pneumatic cylinder lifting means and a seat portion. The base portion is attached to the lifting means by a retaining clip and a fixing block. The lifting means is connected to the seat portion by a pivoting means and can pivotally rotate into a folded and horizontal position with respect to the seat portion by 90 degrees. As a result, the highchair of this invention can be folded into a minimum volume.

According to another aspect of this invention, there is provided a highchair comprising a seat having a body and a pair of attaching sections fixedly provided on both sides of the body, a pair of leg frames provided on both sides of the seat, and a pneumatic lifting means with two ends thereof connected to the seat body and the leg frame respectively. The attaching section is a sliding sleeve provided with a sliding slot therein. The leg frame can pass through the sliding slot.

Since a pneumatic cylinder is used as the lifting means of the highchair of this invention, it can be operated with less labor even an infant sits thereon. The height adjustment of this invention can be easily performed with less labor by providing an activating device in the handgrip portion and also can be detached and folded into a minimum volume. Therefore, this invention is very convenient in conveyance and storage.

BRIEF DESCRIPTION OF THE DRAWINGS

The structure, features and functions of this invention will be described in detail with reference to the following description together with the accompany drawings, in which.

DETAILED DESCRIPTION OF THE PREFERRED EMBODIMENT

This invention will be described with reference to the accompany drawings and a pneumatic cylinder is used to be an embodiment of the lifting means in the highchair of this invention. The seat portion is not the feature of this invention and thus is omitted in the specification for simplicity.

Figure 1:
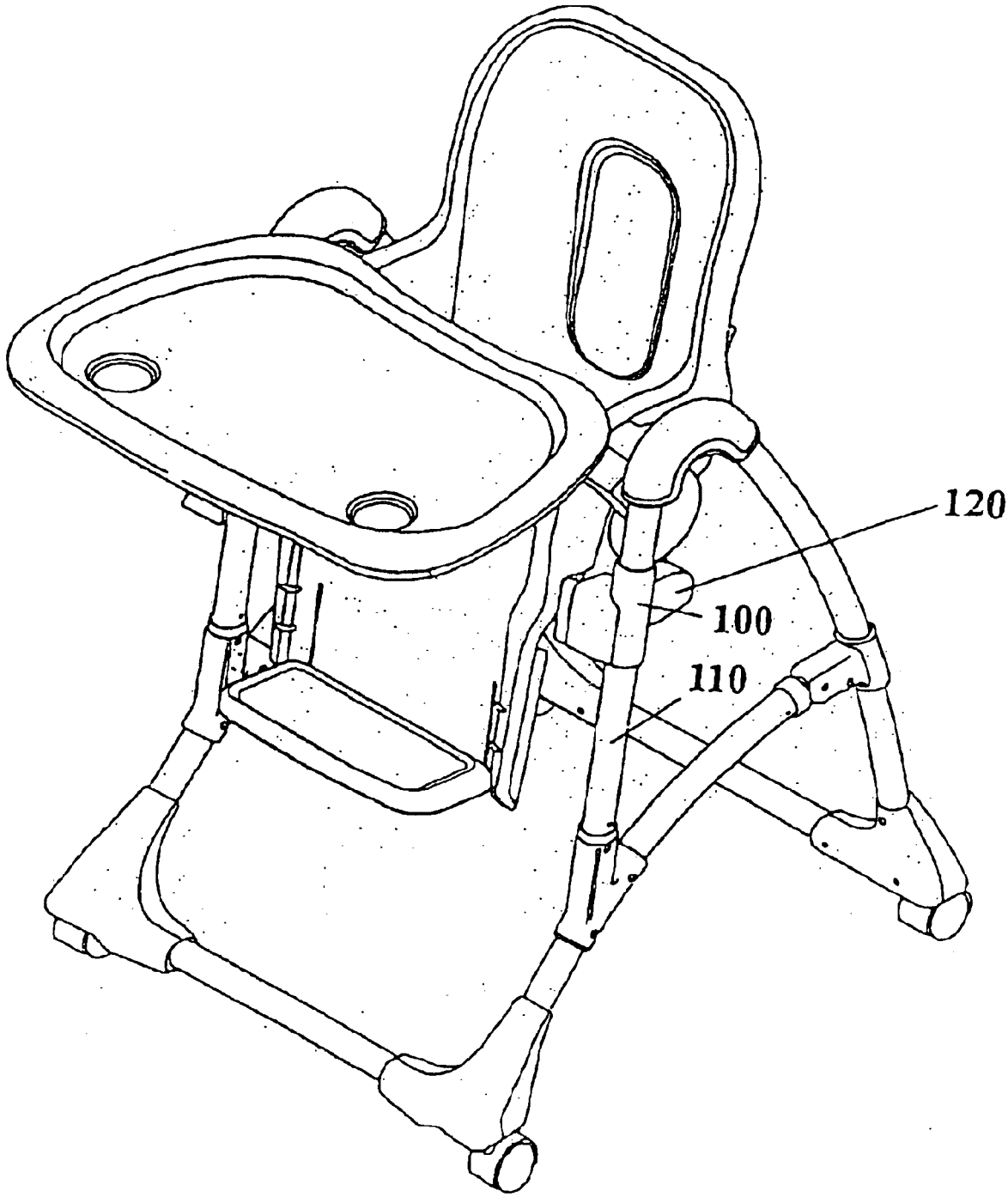
FIG. 1 PRIOR ART
FIG. 1 is a perspective view showing a conventional infant highchair.
Figure 2:
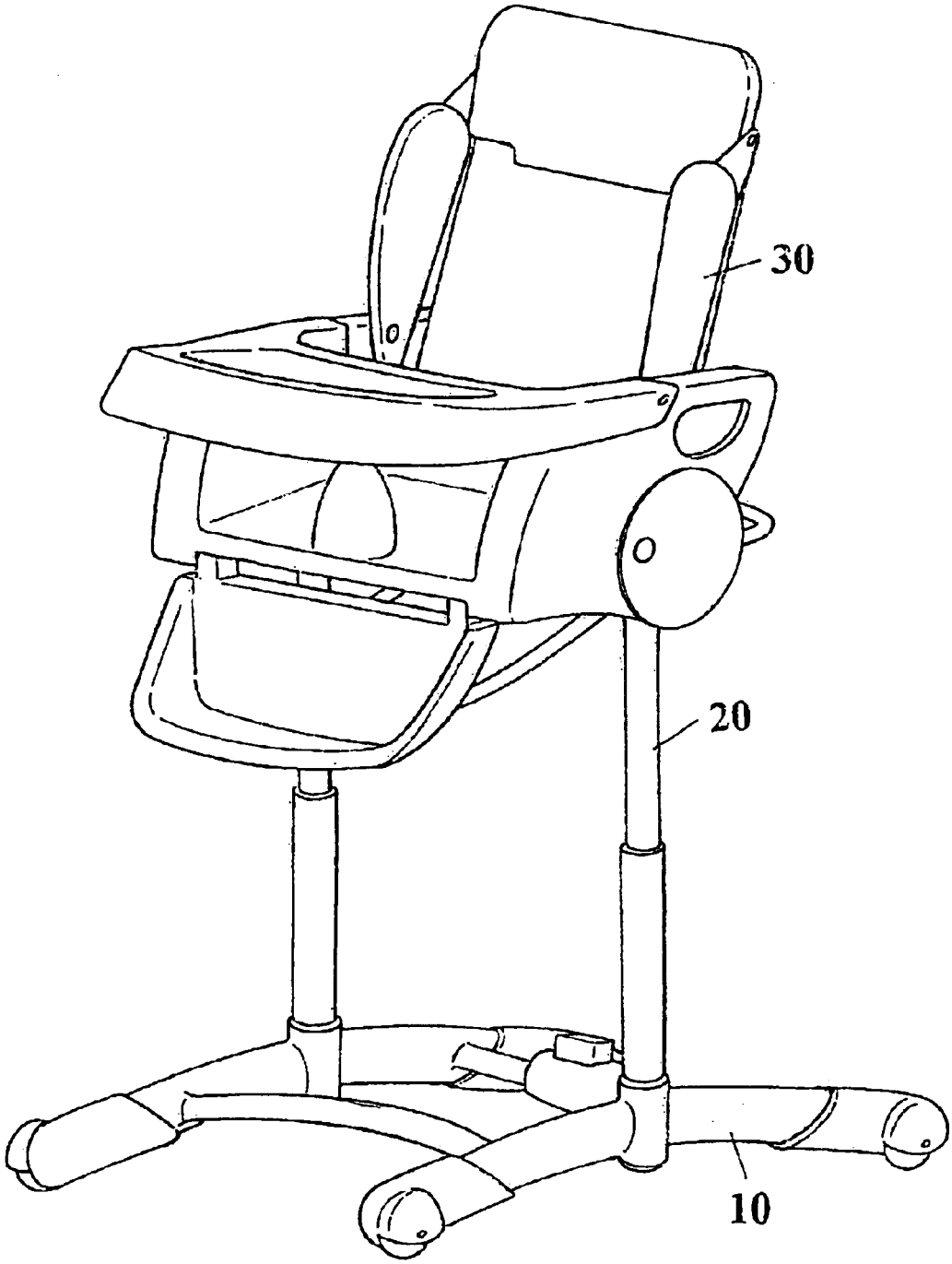
FIG. 2 is a perspective view showing the highchair of this invention in the state of completely attaching and using.
Figure 3:
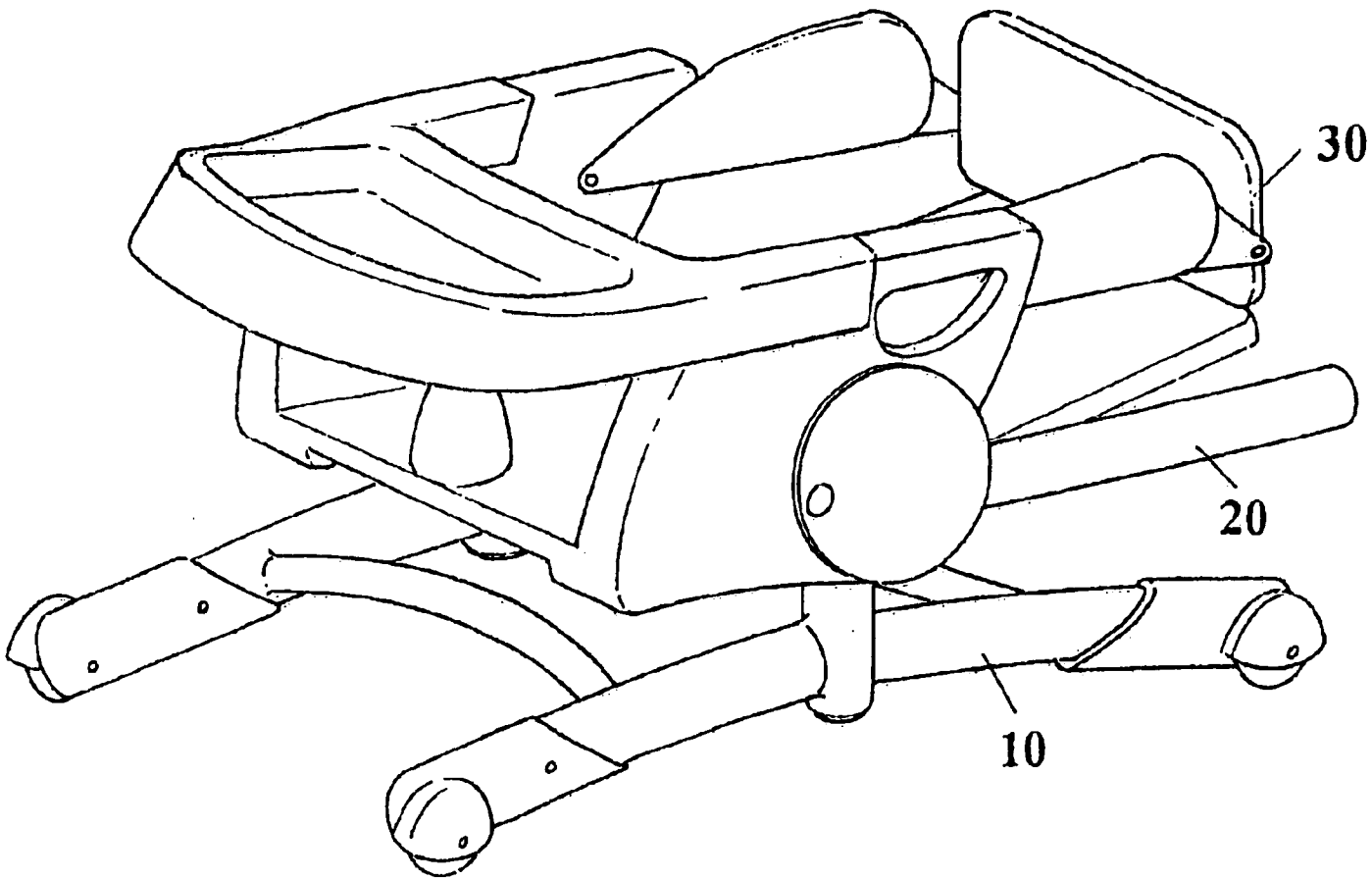
FIG. 3 is a perspective view showing the highchair of this invention in the state of detaching and folding.
Figure 4A:
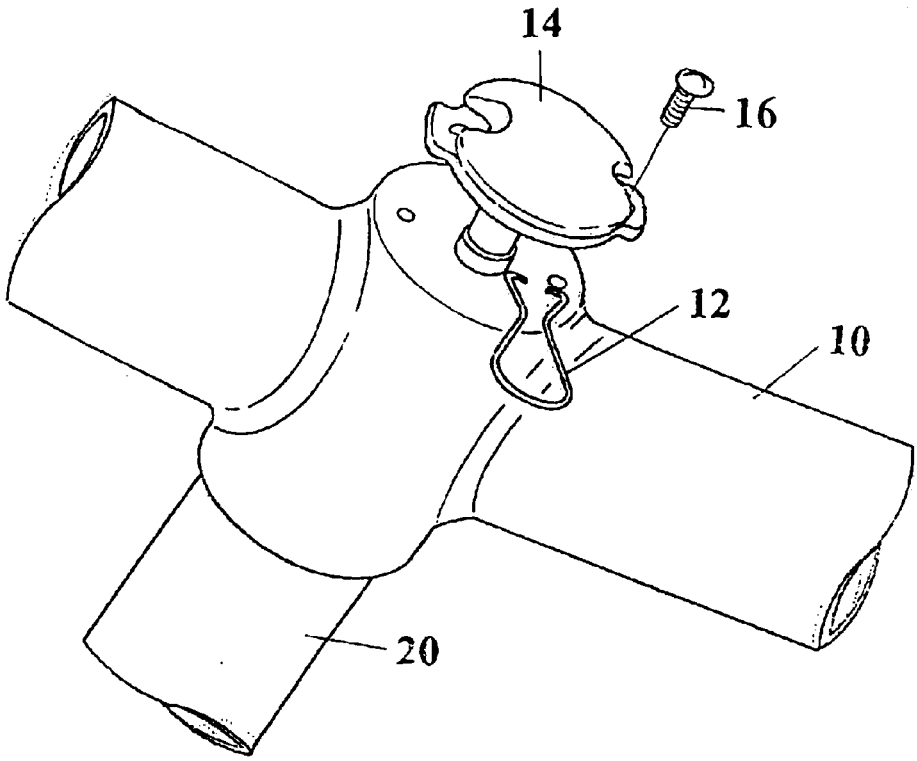
FIG. 4A is a perspective view showing the connection between the lifting means and the base portion of the highchair of this invention.
Figure 4B:
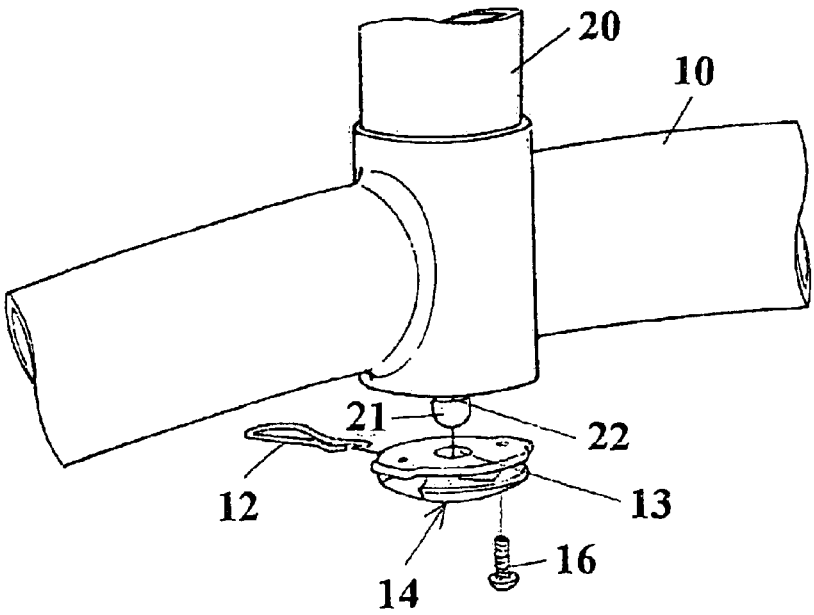
FIG. 4B is an another perspective view showing the connection between the lifting means and the base portion of the highchair of this invention.

As shown in FIG. 2, the highchair of this invention comprises a base portion 10, a lifting means 20 and a seat portion 30. The base portion is a quadrangle frame provided with front wheels and rear wheels on both sides for sliding on the ground. One end of the lifting means 20 is connected to the base portion 10 by a retaining clip 12 and this will be described in detail later. The other end of the lifting means 20 is connected to the seat portion 30. Further, when detaching, the lifting means 20 can pivotally rotate by means of buttons so as to be folded into a minimum volume.

Now, the assembling operation of the base portion 10 with the lifting means 20 will be described. As shown in FIGS.

4A and 4B, a disc-shaped fixing block 14 is provided in the intersection between the base portion 10 and the lifting means 20. A gap is provided within the fixing block 14 for inserting a retaining clip 12 therethrough. Two screw holes are provided on the fixing block 14 adjacent to the base portion 10 that the fixing block 14 can be fixed on the base portion 10 by screws 16. A hole 13 is provided in the center of the fixing block 14 for receiving a round protrusion 21 of the end of the lifting means 20. Then, by inserting the retaining clip 12 in the gap of the fixing block 14, the retaining clip 12 will engage with a neck portion 22 of the end of the lifting means 20 to fix the lifting means 20 on the base portion 10. When the user intends to detach the base portion 10 from the lifting means 20, he/she only needs to draw out the retaining clip 12 by fingers. Therefore, the operation of the detachment/attachment of this invention is very easy.

Figure 5:
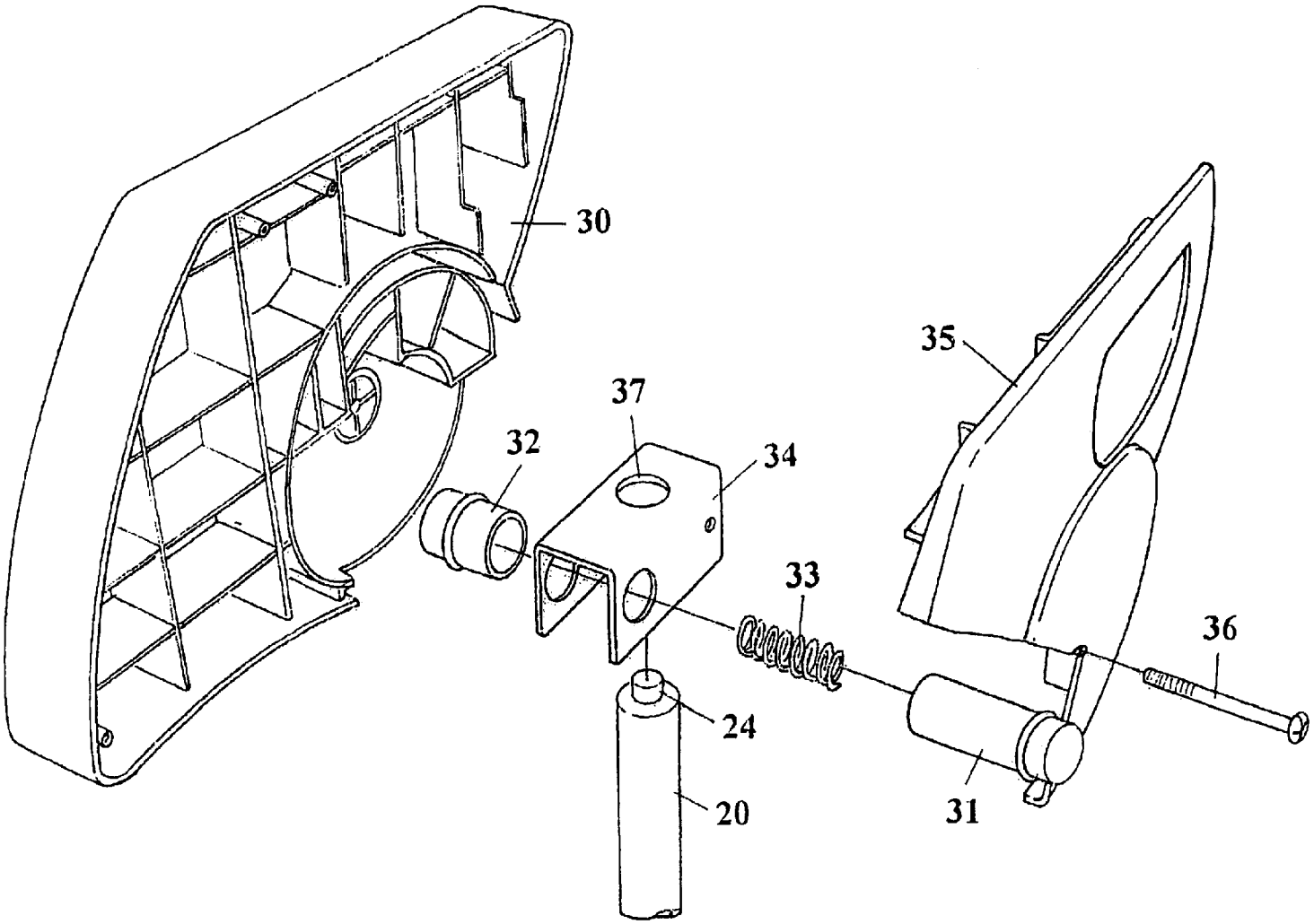
FIG. 5 is an exploded perspective view showing the connection and the pivoting means between the lifting means and the seat portion of the highchair of this invention.
Figure 6B:
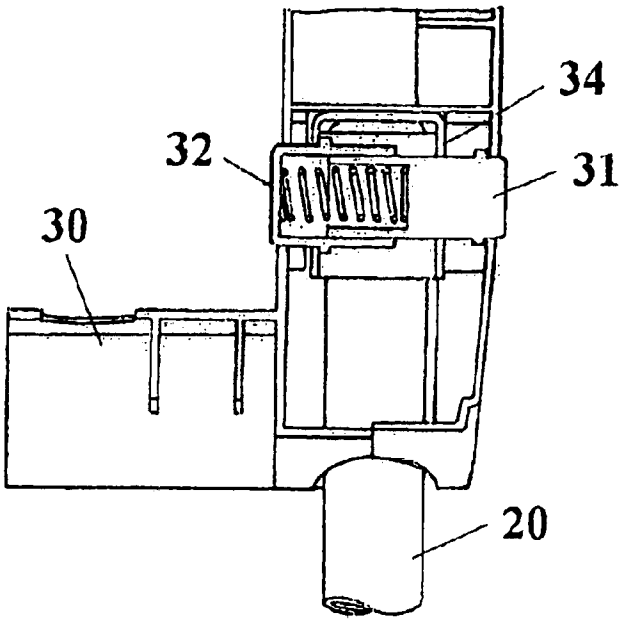
FIG. 6B is a schematic cross sectional view showing the connection between the lifting means and the seat portion of this invention viewed in the direction of arrow E, in which the inner and outer buttons protrude from the connecting piece respectively so as to prevent the lifting means for pivoting.
Figure 6A:
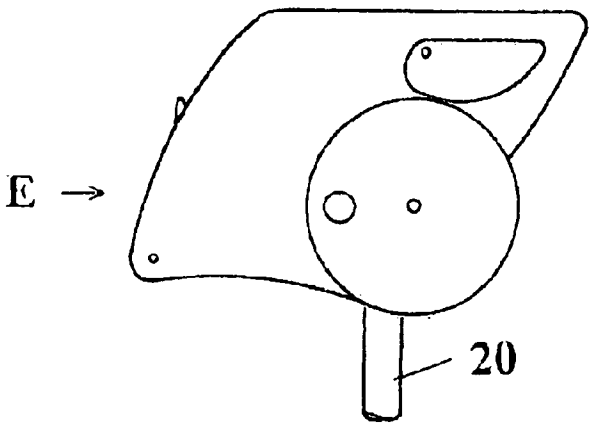
FIG. 6A is a side view showing the lifting means of the highchair of this invention in upright and use.

Next, the connection between the lifting means 20 and the seat portion 30 and the pivoting means will be described. As shown in FIG. 5, a pivoting means is provided in a handgrip of the seat. Each pivoting means comprises a outer button 31, an inner button 32, a button spring 33, a connecting piece 34 and a seat cover 35. Both the inner button 32 and the outer button 31 are in the form of hollow cylinder with flanges in the periphery. The diameter of the inner button 32 is slightly larger than that of the outer button 31 so that the outer button 31 can be inserted into the inner button 32. The connecting piece 34 is a ⊓-shaped elongate steel piece with one hole on each side wall thereof for receiving the inner button and the outer button. Further, the top face of the connecting piece is provided with a hole 37 for a control pin 24 on the top of the lifting means 20 passing therethrough and fixing thereon. The flange of the inner button 32 can abut against the inner wall of the connecting piece 34. The button spring 33 is disposed in the inner button 32 and then the outer button 31 is inserted into the inner button 32. Finally, the seat portion is cover with the seat cover 35 and a rivet 36 is inserted through the seat cover 35, the connecting piece 34 and the seat portion 30. Accordingly, the assembling operation of the pivoting means is complete.

Figure 7B:
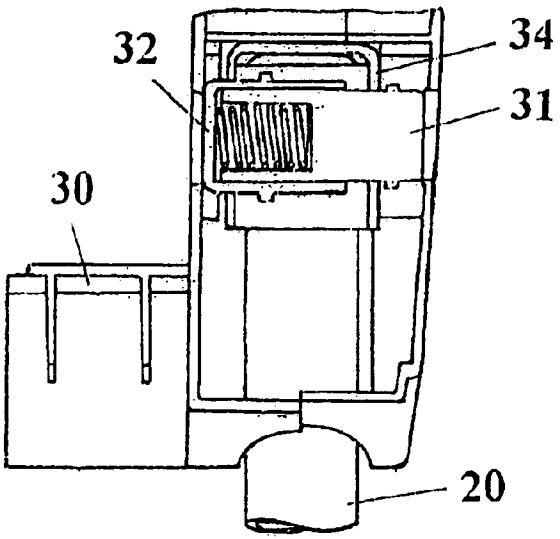
FIG. 7B is a schematic cross sectional view showing the connection between the lifting means and the seat portion of this invention viewed in the direction of arrow F, in which the inner and outer buttons retracted into the connecting piece respectively so that the lifting means can pivotally rotate in the direction of arrow G.
Figure 7A:
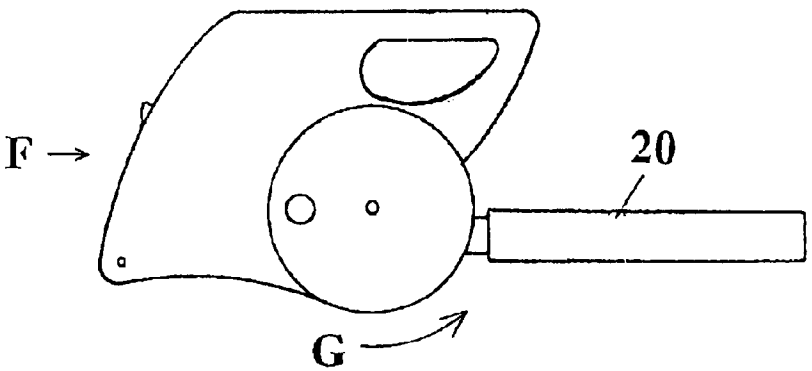
FIG. 7A is a side view showing the lifting means of the highchair of this invention in folding.

Next, the description will be directed to the lifting means 20 when being upright and folded. In order to detach the lifting means 20 from the base portion 10, the user only needs to draw out the retaining clip 12. FIGS .16A and 6B show the lifting means of the highchair of this invention in the state of using. As seen in the figures, the lifting means 20 is perpendicular to the ground. With the biasing force of the button spring, the flange of the inner button 32 abuts against the inner wall of the handgrip of the seat portion 30 and slightly protrudes from the handgrip hole. The flange of the outer button 31 abuts against the inner wall of the seat cover 35 and protrudes from the seat cover 35. At this time, due to the obstruction of the inner buttons and the outer button, the connecting piece 34 can not pivotally rotate so that the lifting means 20 is fixed and perpendicular to the ground. Further, FIGS. 7A and 7B show the lifting means of the highchair of this invention in the state of folding. As seen in the figures, the lifting means 20 is folded to the rear of the seat portion and parallel to the ground. When the user intends to fold the lifting means 20, he/she only needs to press the inner button and outer button with fingers to let the surfaces of both buttons retract into the handgrip hole and the seat cover hole. At this time, the connecting piece can pivotally rotate free from the obstruction of inner button and outer button. Accordingly, the connecting piece and the lifting means pivotally rotate in the direction of arrow G thereby to complete the folding operation of the lifting means.

Incidentally, the height adjustment of the highchair of this invention is achieved by the pneumatic cylinder via the activating device (not shown) provided in the rear portion of the handgrip. The user only needs to operate the activating device by hands to slowly increase the height of the lifting means to a desired level. It should be understood that the activating device of the pneumatic cylinder is not the main characteristic of this invention and can be any conventional device provided on suitable position. Therefore, the activating device is not shown in the drawings in order not to adversely narrow the scope of this invention.

With the above structure, the highchair of this invention has many advantages over prior art. The user can easily overcome the weight of the highchair itself plus the infant sat thereon with the help of the pneumatic cylinder. Therefore, in comparison to the conventional highchair, the operation of the highchair of this invention is much easier and with less labor. Further, during the raising or lowering of the lifting means, the slow speed of the height adjusting will not scare the infant sat thereon. Since the connection between the base portion and the lifting means is achieved by the retaining clip and the fixing block, it is very easy to carry out the operations of attachment and detachment without any additional tools. Further, the lifting means can be folded into a horizontal position and thus the total space and volume occupied by the highchair can be greatly reduced.

Figure 8:
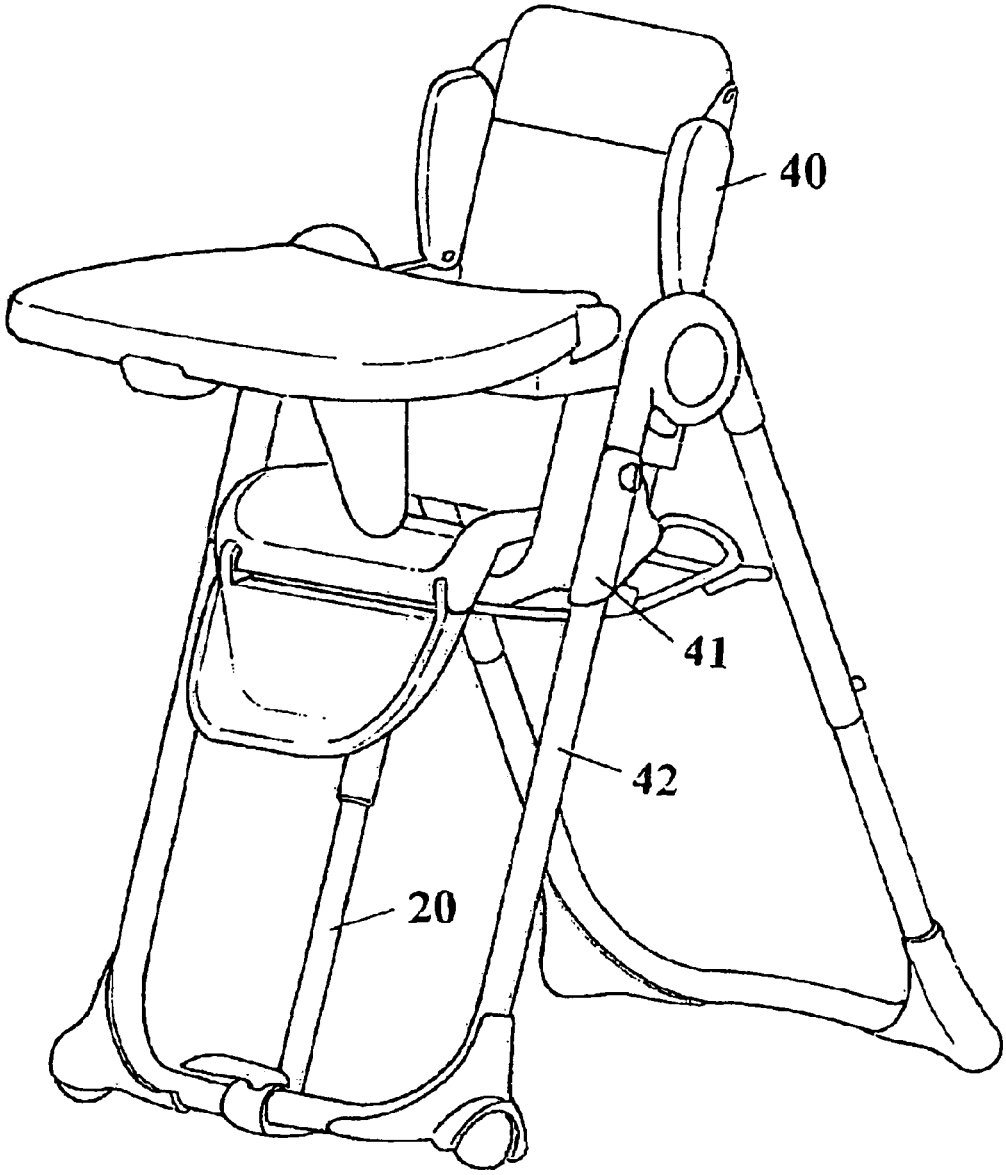
FIG. 8 is a perspective view showing another embodiment of the highchair of this invention.

Although this invention is described by one preferred embodiment using a pair of pneumatic cylinders, this invention is not limited to this. For example, FIG. 8 shows another embodiment of this invention only employing a single pneumatic cylinder. This kind of highchair comprises a seat portion 40 having a body and a pair of attaching sections 41 fixedly provided on both sides of the body, a pair of leg frames 42 on both sides of the seat portion; and a pneumatic cylinder lifting means 20 with two ends thereof connected to the seat body 40 and the lower end of the leg frame 42. Each attaching section 41 is a sliding sleeve provided with a sliding slot therein. The leg frame passes through the sliding slot. The lifting means 20 is also connected to the lower end of the leg frame 42 by the same retaining clip and the fixing block as those in the first embodiment. Therefore, the highchair using single pneumatic cylinder as lifting means is achieved. Certainly, the lifting means can be a hydraulic cylinder. Any modification can be easily made on the structure of this invention by those skilled in this art after reviewing the specification. Therefore, such simple modification is still within the scope of the appended claims of this invention.

Finally, the applicant wants to emphasize that the pneumatic lifting means has never been used in an infant highchair even though the principle of pneumatic cylinder is conventional. Therefore, in view of the drawbacks of existing conventional highchairs, the applicant employs a pneumatic lifting means to produce a novel and improved highchair, which can be operated with less labor and folded into a minimum volume. This invention indeed has advantages over prior art in terms of the usage, conveyance and the convenience for carrying.

What is claimed is:

1. A highchair, comprising:

a base portion;

a seat portion; and a pneumatic cylinder lifting means, wherein both ends of the lifting means are connected to the base portion and the seat portion, respectively, wherein the base portion is connected to the lifting means by a retaining clip and a fixing block, the other end of the lifting means is connected to the seat portion by a pivoting device so that the lifting means can pivotally rotate into a folded and horizontal position with respect to the seat portion by 90 degrees.

2. The highchair according to claim 1, wherein the pivoting device comprises an outer button, an inner button, a button spring, a connecting piece and a seat cover.

3. The highchair according to claim 2, wherein the lifting means can pivotally rotate into a folded and horizontal position with respect to the seat portion by pressing the inner button and outer button.

* * * * *